United States Patent [19]

Thogersen et al.

[11] Patent Number: 4,842,261

[45] Date of Patent: Jun. 27, 1989

[54] PRINTER FEEDER

[75] Inventors: Klaus Thøgersen, Newport Beach; Frederick J. Lawrence, Tustin, both of Calif.

[73] Assignee: Gradco Systems, Inc., Irvine, Calif.

[21] Appl. No.: 484,608

[22] Filed: Apr. 13, 1983

[51] Int. Cl.[4] ..... B65H 5/22

[52] U.S. Cl. ..... 271/6; 271/198; 400/625; 400/629

[58] Field of Search ..... 271/4, 6, 7, 12, 16, 271/275, 264, 265, 266, 268, 272–274, 198; 400/625, 624, 629

[56] References Cited

U.S. PATENT DOCUMENTS

| | | | |
|---|---|---|---|
| 1,564,937 | 12/1925 | Cambell | 400/629 |
| 4,275,964 | 6/1981 | Matsuhisa et al. | 400/629 |
| 4,340,314 | 7/1982 | Berger | 400/629 |
| 4,362,100 | 12/1982 | Wu et al. | 400/629 |

*Primary Examiner*—Joseph J. Rolla

*Attorney, Agent, or Firm*—Newton H. Lee, Jr.

[57] ABSTRACT

A sheet feeder for automatic printers has a single cassette sheet feeder in which the printer rests. The printer supports an over-the-top feed apparatus which receives sheets from the cassette and transports sheets to the platen of the printer and from the platen to a receiver.

1 Claim, 3 Drawing Sheets

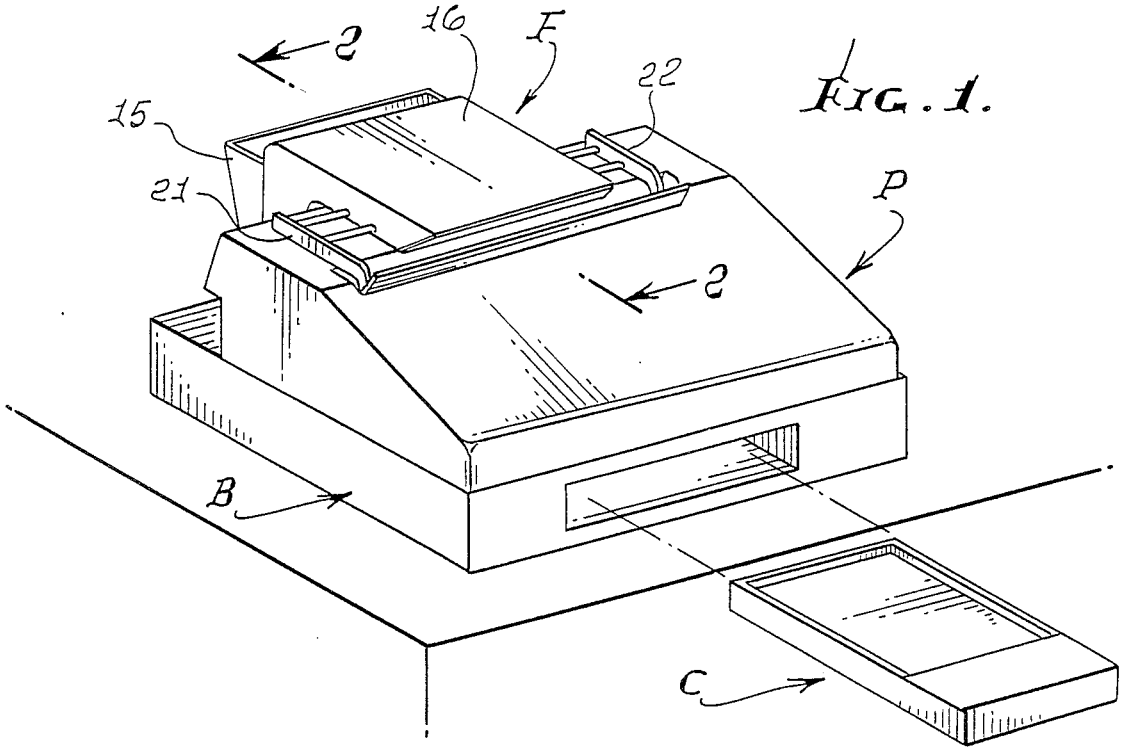
FIG. 1.
FIG. 4.
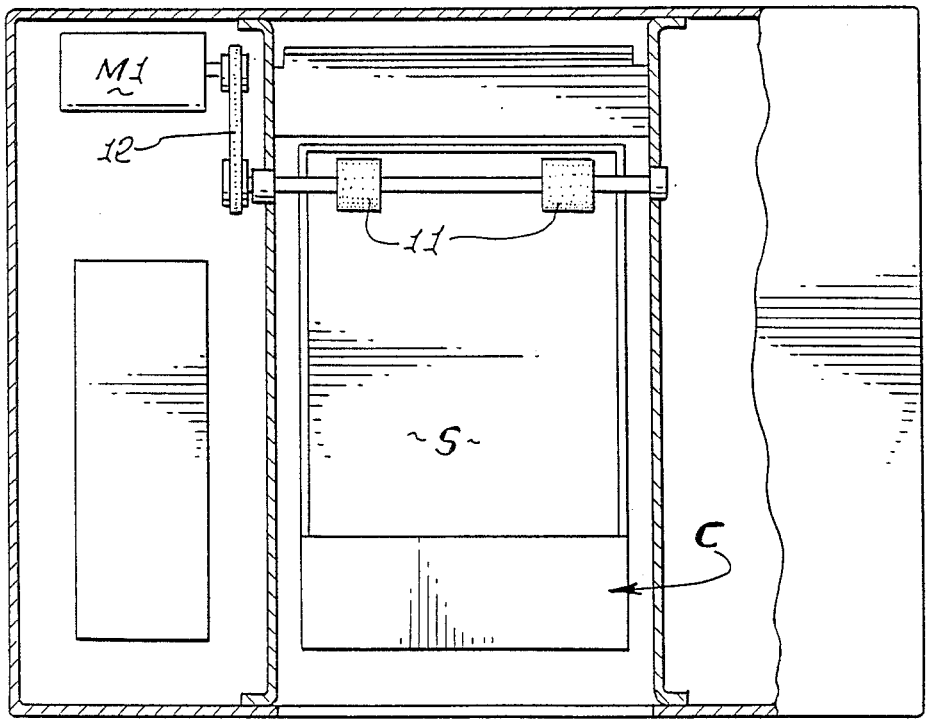

PRINT HD.
3
4
F
P
S
M1
10
11
12
14
15
16
17
21
22
23
24
30
31
32
33
34
35
36
37
38
39
40
41
42
43

22
27
26
25
24
20
28
36
43
18
29
33
34
30
32
38
39
35
17
19
5
23
5
21
24

PRINTER FEEDER

BACKGROUND OF THE INVENTION

Printing machines are in common use, including daisy wheel and dot matrix or ink jet printers, which are computer controlled and which automatically print programmed material. In most instances sheets are manually fed to such printers, thereby requiring the presence of an attendant.

Sheet feeders have also been proposed, as shown in the following illustrative U.S. Pat: Nos.

| | | |
|---|---|---|
| 4,236,709 | Dec. 2, 1980 | Hunt |
| 4,248,415 | Feb. 3, 1981 | Steinhilber |
| 4,240,622 | Dec. 23, 1980 | Rutishauser |

In the pending application of Hamma et al, Ser. No. 385,560, filed June 7, 1982, there is disclosed an automatic sheet feeder for printers wherein a pair of cassettes are provided in a cabinet beneath the printer to automatically feed sheets upwardly through a slot in the frame of the printer. Such a feeder is effective for those printers having a bottom slot, but the printer requires some modification.

SUMMARY OF THE INVENTION

The present invention has as an object the provision of a sheet feeder for printers which can be applied to the printer without modification.

More particularly, the present feeder includes a single cassette for holding a supply of sheets in a base on which the printer is supported. The sheets are sequentially removed from the cassette and transported rearwardly of the printer to another feeder mechanism which rests on the printer and receives its power or drive from the platen of the printer, to move sheets upwardly, over the top of the printer to the platen.

Thereafter, following operation of the printer, the sheet is carried to a receiver.

Sheets are fed to the printer in the normal manner, that is to the top of the printer for engagement by the platen, and the sheet is discharged from the printer also in the normal manner, that is, upwardly and rearwardly, as the printing progresses.

This invention possesses many other advantages and has other purposes which may be made more clearly apparent from a consideration of the forms in which it may be embodied. The preferred form is shown in the drawings accompanying and forming part of the present application. It will now be described in detail, for the purpose of illustrating the general principals of the invention; but it is to be understood that such detailed description is not to be taken in a limiting sense.

BRIEF DESCRIPTION OF THE DRAWINGS

FIG. 1 is a perspective showing the invention in association with a printer;

FIG. 4 is a horizontal section on the line 4—4 of FIG. 3; and

DESCRIPTION OF THE PREFERRED EMBODIMENT

Figures 2, 5:
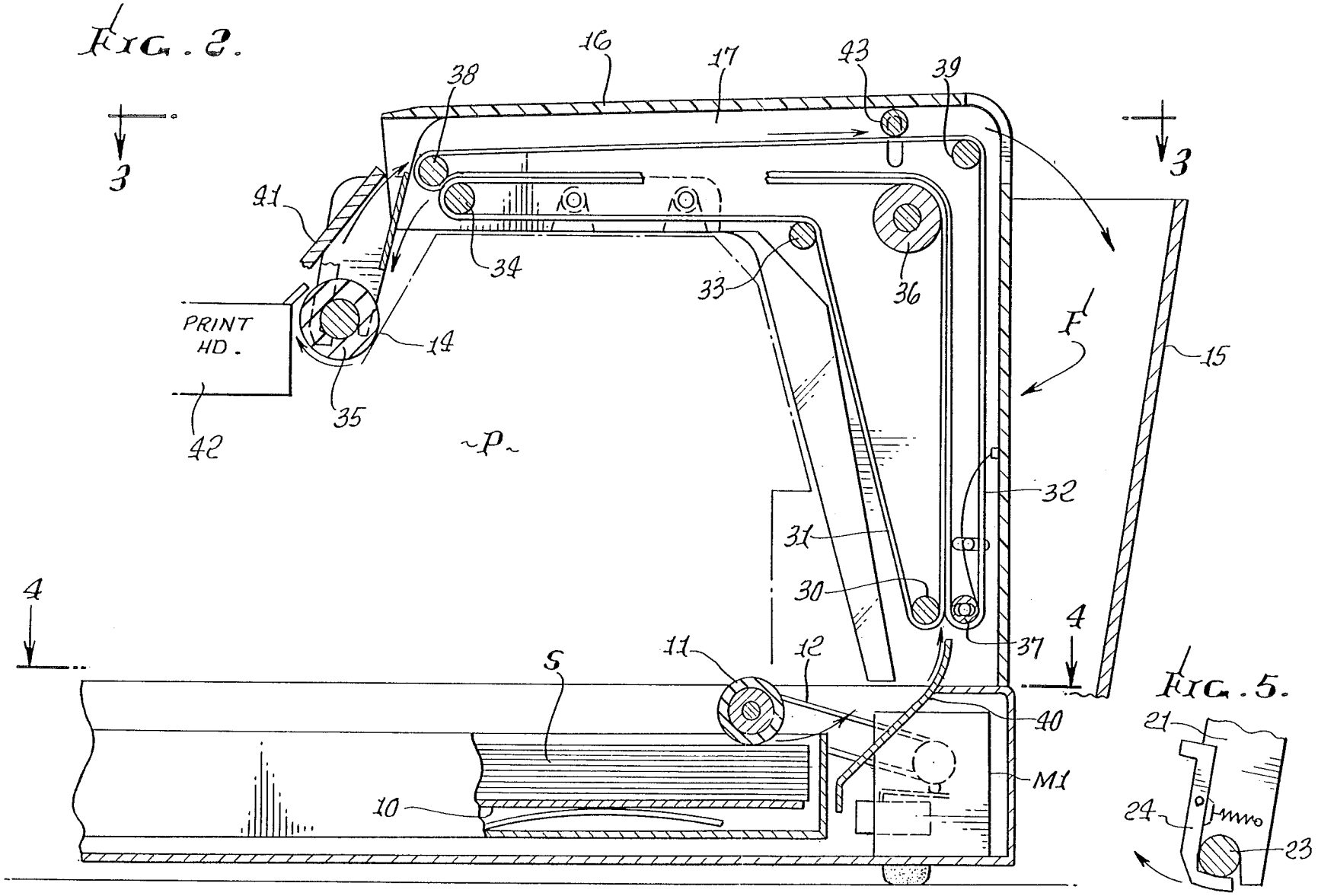
FIG. 2 is a vertical section on the line 2—2 of FIG. 1.
FIG. 5 is a fragmentary detail section on the line 5—5 of FIG. 4.
Figure 3:
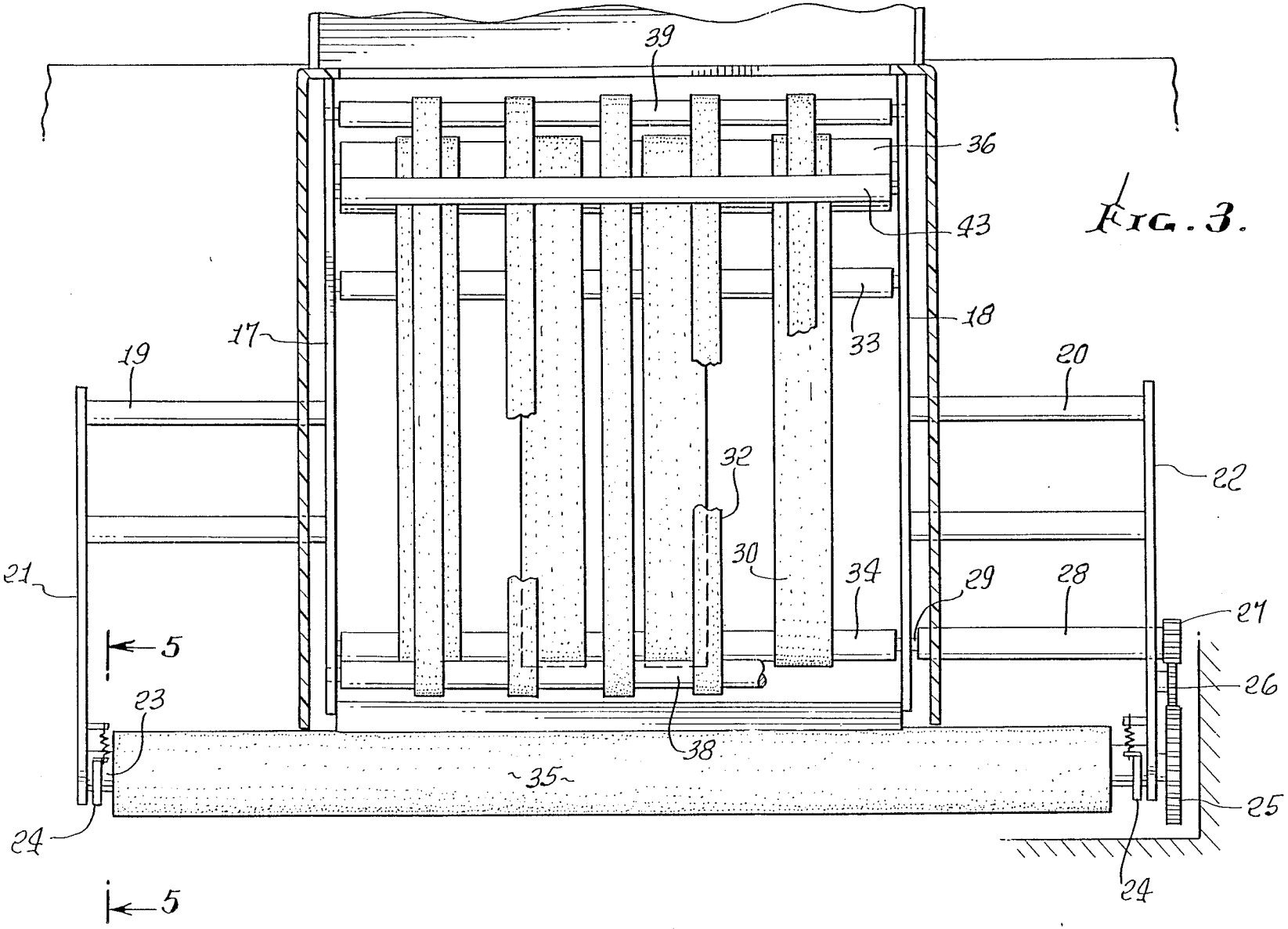
FIG. 3 is a horizontal section on the line 3—3 of FIG. 2.

As seen in the drawings, the typical automatic printer P is associated with sheet feeding means including a base B and an over-the-top feeder F. The base B is adapted to receive a sheet cassette of any well known type adapted to contain a quantity a cut sheets of paper.

As best seen in FIG. 2, sheets S are contained in the cassette and are biased upwardly by a spring loaded bottom plate 10 to maintain the upper sheet in contact with a friction drive roll 11 adapted to be driven by a motor M1 and belt 12 drive, to supply sheets to the feeder F. Feeder F is adapted to transport successive sheets, as indicated by the arrows, upwardly over the top of printer P to the platen 14 and following operation of the printer, rearwardly to a sheet receiver 15.

The feeder F is preferrably covered by a transparent cover 16 enabling a user to view the pasasge of sheets to and from the printer and also enabling any jammed sheet to be removed when the cover is lifted from the apparatus.

The feeder comprises a side frame structure in the form of laterally spaced inverted L shaped plates 17 and 18 between which conveyor belt shafts extend and are mounted for rotation, as will be later described. A pair of laterally extended supports 19 and 20 are connected to the side plates and have downwardly extended side pieces 21 and 22 which extend downwardly into the printer to rest on the platen shaft 23, as seen in FIG. 5. Spring loaded keepers 24 connect the side plates to the platen shaft.

As seen in FIG. 4, the feeder conveyor means is driven by a power take off from the platen shaft. A drive gear 25 for the platen meshes with an idler gear 26 on the feeder frames which is in mesh with a driven gear 27 on a drive shaft 28 connected at 29 with a conveyor shaft 30 which extends between the side frame members 17 and 18.

The conveyor means includes a pair of flexible belts 31 and 32. Belt 31 extends about driven shaft 30 and upwardly over a shaft 33, above the top of the printer, and then forwardly about another shaft 34 which is located above the platen 35. Belt 31 then returns rearwardly over a large roll 36 and vertically behind the printer to shaft 30. Belt 32 extends about a lower shaft 37 upwardly in confronting relation with belt 31 over large roll 36 and forwardly to a shaft 38 above the platen, belt 32 then returning over a shaft 39 and down the rear of the feeder to shaft 37.

The confronting belts 31 and 32 form a paper path to which sheets are directed from the cassettes by a curved guide plate 40. The upper shafts 34 and 38 are so disposed that sheets exiting the sheet path are directed to the platen. An outer guide 41 above the print head 42 deflects the sheet into the space between the cover 16 and the upper run of belt 32. A pressure roll 43 rests on the upper run of the belt 32 to drive the sheet to the receiver 15 after the sheet is no longer driven by the platen.

In use, under the control of the computer which is associated with the printer sheets are sequentially fed to the platen which is timed with the conveyor by the gears 26 and 27. As printing progresses the sheet is further fed, line by line, and is ultimately discharged from the conveyor into the receiver.

From the foregoing, it will now be apparent that the invention provdies a simple sheet feeding cassette and an overthe-top sheet conveyor which facilitates use of the printer.

We claim:

1. Sheet feeding apparatus for automatic printers having a platen on a shaft rotatable in the frame of the printer, said apparatus comprising a support structure including an upper section adapted to be disposed horizontally above the printer and a rear section adapted to extend downwardly at the rear of the printer, a drive shaft, power take off drive means for driving said drive shaft in response to rotation of said platen, conveyor means supported by said support structure and extending upwardly through said rear section and horizontally through said upper section, for carrying sheets upwardly through said rear section and across said upper section, means at the front of said conveyor means in said upper section to direct sheets downwardly to said platen, said conveyor means including a first pair of continuous belts, a pair of rollers adjacent to the lower end of said rear section, a second pair of rollers at the front of said upper section, a single roller at the rear of said top section, said belts extending about said first pair and second pair of rollers in continuous confronting relation to one another to define a sheet path from the bottom rear of the printer, over-the-top of the printer to the platen, one of said belts having a return run extending over said single roller from one of said second pair of rollers to carry sheets from said platen, said upper section also having means to direct a sheet from the platen to the top of said return run.

* * * * *